US007689150B2

(12) United States Patent
Uetake et al.

(10) Patent No.: US 7,689,150 B2
(45) Date of Patent: Mar. 30, 2010

(54) IMAGE FORMING APPARATUS USING TRAPEZOIDAL SHAPED ELECTRIC FIELD AND METHOD FOR FORMING IMAGE

(75) Inventors: Shigeo Uetake, Takatsuki (JP); Toshiya Natsuhara, Takarazuka (JP); Junya Hirayama, Takarazuka (JP); Takeshi Maeyama, Ikeda (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 162 days.

(21) Appl. No.: 11/986,002

(22) Filed: Nov. 19, 2007

(65) Prior Publication Data

US 2008/0124135 A1 May 29, 2008

(30) Foreign Application Priority Data

Nov. 24, 2006 (JP) ..... 2006-316852
Nov. 29, 2006 (JP) ..... 2006-321334
Oct. 26, 2007 (JP) ..... 2007-278707

(51) Int. Cl.
*G03G 15/08* (2006.01)
*G03G 15/09* (2006.01)

(52) U.S. Cl. ..... 399/285; 399/270; 430/123.2

(58) Field of Classification Search ..... 399/285, 399/270, 55; 430/122.1, 123.2, 108.1
See application file for complete search history.

(56) References Cited

U.S. PATENT DOCUMENTS 5,592,271 A * 1/1997 Parker et al. ..... 399/285
5,991,587 A 11/1999 Kikuchi ..... 399/282
6,219,499 B1 * 4/2001 Hayashi ..... 399/55
6,512,909 B2 1/2003 Ozawa et al. ..... 399/270
6,721,516 B2 4/2004 Aoki et al. ..... 399/55
2004/0228661 A1 * 11/2004 Fujishima et al. ..... 399/285 X
2004/0234300 A1 * 11/2004 Okamura ..... 399/285
2006/0062606 A1 * 3/2006 Okada ..... 399/285

FOREIGN PATENT DOCUMENTS

JP 59-100471 6/1984

(Continued)

OTHER PUBLICATIONS

Machine translation of JP 2003-215855 A dated Jun. 29, 2009.*

*Primary Examiner*—Sophia S Chen
(74) *Attorney, Agent, or Firm*—Brinks Hofer Gilson & Lione

(57) ABSTRACT

An object of the present invention is to provide an image forming apparatus and a method for forming an image that are capable of controlling the consumption of opposite polarity particles and suppressing the reduction of toner charge amount due to the carrier deterioration and can form high quality images over a long period of time even in the case where large quantities of images with small image area ratio are printed. The image forming device includes a developer further including the opposite polarity particles, a developer carrying member, a toner carrying member, and a voltage applying section for applying bias voltage overlapped with alternating current between the toner carrying member and the image carrying member, wherein the bias voltage overlapped with alternating current is a vibrating waveform including a trapezoidal wave, or a vibrating waveform in which a blank is inserted during application of a reverse development side voltage component.

14 Claims, 6 Drawing Sheets

FOREIGN PATENT DOCUMENTS

| | | |
|---|---|---|
| JP | 09-185247 | 7/1997 |
| JP | 2000-298396 | 10/2000 |
| JP | 2002-108104 | 4/2002 |
| JP | 2003-057882 | 2/2003 |
| JP | 2003-215855 | 7/2003 |
| JP | 2005-189708 | 7/2005 |

* cited by examiner

IMAGE FORMING APPARATUS USING TRAPEZOIDAL SHAPED ELECTRIC FIELD AND METHOD FOR FORMING IMAGE

This application is based on Japanese Patent Application No. 2006-316852 filed on Nov. 24, 2006, No. 2006-321337 filed on Nov. 29, 2006, and No. 2007-278707 filed on Oct. 26, 2007, in Japanese Patent Office, the entire content of which is hereby incorporated by reference.

TECHNICAL FIELD

The present invention relates to an image forming apparatus and a method for forming an image.

BACKGROUND

In an image forming apparatus based on electrophotographic method, a one-component developing system and a two-component developing system have been known, wherein the one-component developing system uses only toner as a developer in the development method for electrostatic latent image formed on an image carrying member, whereas the two-component developing system uses both toner and carrier.

In the one-component developing system, a toner carrying member and a regulating plate pressed against the toner carrying member are generally used. Control of film thickness is performed by pressing the toner on the toner carrying member by the regulating plate, thereby forming a thin toner layer charged with a predetermined amount of charge. An electrostatic latent image on an image carrying member is developed with this thin toner layer. This system is characterized by excellent dot reproducibility and effective production of uniform image with minimum irregularity. It is also considered to provide advantages in apparatus simplification, downsizing and cost-cutting. However, a heavy stress placed on the toner causes such a problem that the toner surface is degenerated, and toner or external additive agents are deposited on the surfaces of the toner regulating member or toner carrying member, with the result that fogging and contamination in the apparatus are caused both because of the poorly charged toner. As a result, the service life of the developing device will be reduced.

In the two-component developing system, on the other hand, toner is charged by triboelectric charging due to the mixture with a carrier. This is characterized by smaller stress and greater resistance to deterioration of toner. Further, as the carrier as a toner charging member has a greater surface area, it is relatively resistant to possible contamination by toner or external additive agents, whereby a longer service life can be expected.

However, when the two-component developer is utilized, contamination of the carrier surface is also caused by toner or external additive agents. The charge amount of toner will be reduced by a long-term use, and problems of fogging or toner splashing will arise. The service life is not sufficient, and prolonging the service life are desired.

One of the ways of prolonging the service life of the two-component developer is found in the Unexamined Japanese Patent Application Publication No. 59-100471, which discloses a developing device wherein a carrier is supplied little by little independently or together with toner, and the deteriorated developer of reduced charge is ejected in response to that, whereby the carrier is replaced by a new one, so that the percentage of the deteriorated carrier will be reduced. In this apparatus, the reduction in the toner charge due to carrier deterioration is kept to a predetermined level by replacement of the carrier. Thus, the service life is prolonged.

The Unexamined Japanese Patent Application Publication No. 2003-215855 discloses a two-component developer and a development method using the developer, the developer which is made up of the carrier and toner and is externally added opposite polarity particles having a polarity opposite. The opposite polarity particles in the development method act as abrasive powder and spacer particles, and are proved to have ability of reducing the deterioration of the carrier by the effect of removing the spent matters from the carrier surface.

The Unexamined Japanese Patent Application Publication No. H9-185247 discloses a so-called hybrid development method wherein the latent image on the image carrying member is developed using the toner carrying member that carries only toner from a two-component developer. The hybrid development method is characterized by the absence of irregularities on the image caused by a magnetic brush, and excellent dot reproducibility and image uniformity. Since there is no direct contact between the image carrying member and magnetic brush, there is no carrier movement to the image carrying member (carrier consumption). Thus, the hybrid development method has many advantages that cannot be expected in a conventional two-component developing system. In the hybrid development method, toner is charged by triboelectric charging with a carrier. The keeping of charge applying property is important for stabilizing the toner charging property and maintaining high image quality for a long period of time.

However, the Unexamined Japanese Patent Application Publication No. 59-100471 requires a mechanism to collect the ejected carrier and involves such problems as higher costs and environmental problems since the carrier is consumable. Further, as the printing operation in a predetermined amount must be done before the ratio of new carrier to old one is stabilized, initial characteristics cannot be kept for long. Further, in the Unexamined Japanese Patent Application Publication No. 2003-215855, when the area ratio of the image portion in the output image (image area ratio) is smaller, there is an increase in the amount of consumption of the opposite polarity particles on the non-image portion, as compared to the amount of consumption of the toner on the image portion on the image carrying member. When a great number of the images having a smaller image area ratio have been printed, there is a decrease in the amount of the opposite polarity particles in the developing device. Thus, the advantage of the opposite polarity particles for reducing the deterioration of the carrier cannot be fully demonstrated. This results in raising the problems of a reduction in the amount of toner charge and image deterioration. Further, the Unexamined Japanese Patent Application Publication No. H9-185247 has a problem that the carrier surface is contaminated by toner and post-processing agent as the volume of printing increases, with the result that the charge applying property of the carrier is deteriorated.

SUMMARY

An object of the present invention is to provide an image forming apparatus that is capable of controlling the consumption of opposite polarity particles and suppressing toner charge reduction due to the carrier deterioration and form high quality images over long period of time even in the case where large quantities of images with small image area ratio are printed.

In view of forgoing, one embodiment according to one aspect of the present invention is an image forming apparatus, comprising:

an image carrying member which is adapted to carry an electrostatic latent image;

a developer container which is adapted to contain a developer including a toner, a carrier for charging the toner, and opposite polarity particles to be charged opposite to a charge polarity of the toner;

a developer carrying member which is adapted to convey the developer supplied from the developer container;

a toner carrying member which is adapted to receive the toner from the developer on the developer carrying member and to convey the toner to a development position facing the image carrying member to develop the electrostatic latent image on the image carrying member; and an electric field forming section which is adapted to form an electric field between the image carrying member and the toner carrying member, the electric field including a DC component overlapped with an AC component, wherein the AC component of the electric field formed by the electric field forming section includes a trapezoidal wave.

According to another aspect of the present invention, another embodiment is an image forming apparatus, comprising:

an image carrying member which is adapted to carry an electrostatic latent image;

a developer container which is adapted to contain a developer including a toner, a carrier for charging the toner, and opposite polarity particles to be charged opposite to a charge polarity of the toner;

a developer carrying member which is adapted to convey the toner supplied from the developer container;

a toner carrying member which is adapted to receive the toner from the developer on the developer carrying member and to convey the toner to a development position facing the image carrying member to develop the electrostatic latent image on the image carrying member; and an electric field forming section which is adapted to form an electric field between the image carrying member and the toner carrying member, the electric field including a DC component overlapped with an AC component, wherein the AC component of the electric field formed by the electric field forming section includes a developing component which moves the toner to the image carrying member and a reverse-developing component which moves the toner to the toner carrying member, and a blank is formed within the reverse-developing component.

According to another aspect of the present invention, another embodiment is a method for forming an image, the method comprising the steps of:

forming an electrostatic latent image on an image carrying member;

supplying a developer carrying member with a developer including a toner, a carrier for charging the toner, and opposite polarity particles to be charged opposite to a charge polarity of the toner;

transferring the toner from the developer carrying member onto the toner carrying member;

conveying the toner to a position facing the image carrying member by a movement of a surface of the toner carrying member, the opposite polarity particles being attached to the toner; and forming an electric field including a DC component overlapped with an AC component between the image carrying member and the toner carrying member to develop the electrostatic latent image on the image carrying member with the toner on the toner carrying member, the AC component including a trapezoidal wave.

According to another aspect of the present invention, another embodiment is a method for forming an image, the method comprising the steps of:

forming an electrostatic latent image on an image carrying member;

supplying a developer carrying member with a developer including a toner, a carrier for charging the toner, and opposite polarity particles to be charged opposite to a charge polarity of the toner;

transferring the toner from the developer carrying member onto the toner carrying member;

conveying the toner to a position facing the image carrying member by a movement of a surface of the toner carrying member, the opposite polarity particles being attached to the toner; and forming an electric field including a DC component overlapped with an AC component between the image carrying member and the toner carrying member to develop the electrostatic latent image on the image carrying member with the toner on the toner carrying member, the AC component including a developing component which moves the toner to the image carrying member and a reverse-developing component which moves the toner to the toner carrying member, and a blank being formed within the reverse-developing component.

DETAILED DESCRIPTION OF THE PREFERRED EMBODIMENT

The embodiments of the present invention will be described in the following with reference to the drawings.

Figure 1:
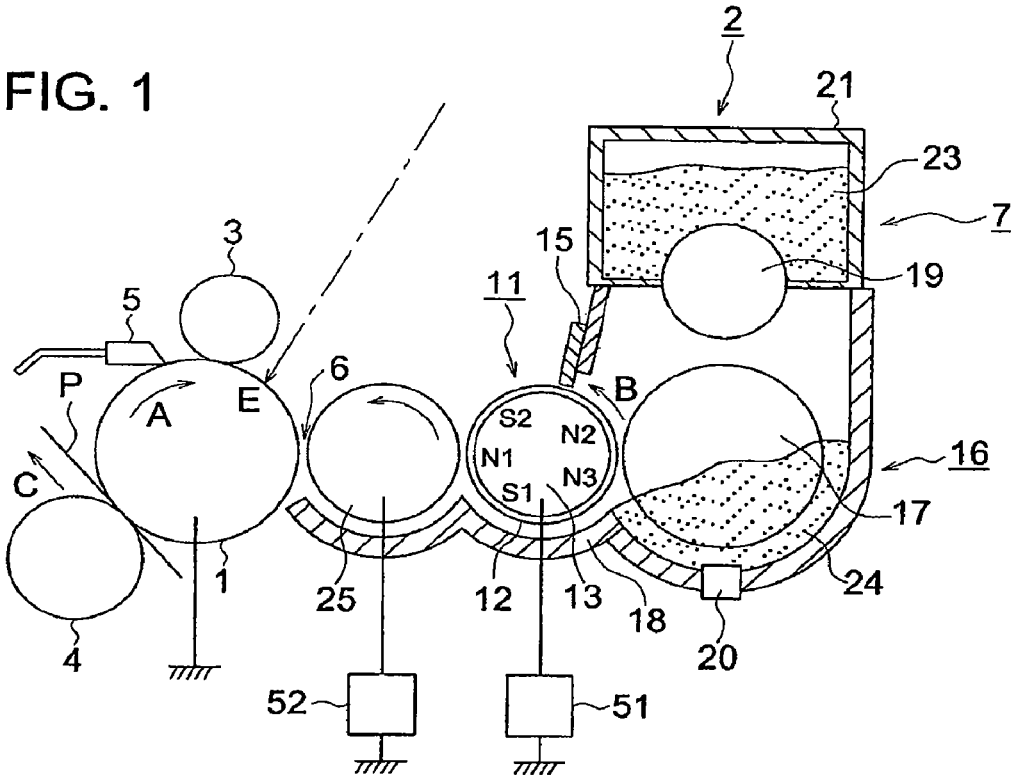
FIG. 1 shows the main parts of an image forming apparatus according to an embodiment of the present invention.

FIG. 1 shows the main parts of an image forming apparatus according to an embodiment of the present invention. The image forming apparatus is a printer in which the toner image formed on the image carrying member 1 using an electrophotographic system is transferred to a transfer medium P such as paper or the like, and image formation is carried out. This image forming apparatus comprises an image carrying member 1 which carries images, and around the image carrying member 1 a charging device 3 for charging the image carrying member 1; a developing device 2 for developing the electrostatic latent images on the image carrying member 1; transfer rollers 4 for transferring the toner image on the image carrying member 1; and a cleaning blade 5 for removing residual toner on the image carrying member 1 are disposed in that order along the rotation direction A of the image carrying member 1.

After the image carrying member 1 is charged by the charging device 3, it is exposed by an exposure device (not shown) at position E in the diagram and electrostatic latent images are formed on the surface of the image carrying member 1. The developing device 2 develops the electrostatic latent images into toner images. The transfer roller 4 transfers the toner images on the image carrying member 1 onto the transfer medium P and then ejects the transfer medium P in the arrow C direction in the drawing. The cleaning blade 5 removes the residual toner on the image carrying member 1 after transfer using mechanical force. The image carrying member 1 used in the image forming apparatus, the charging device 3, the exposure device, the transfer roller 4, the cleaning blade 5 and the like that are used may be suitably selected based on known electrophotographic system technology. For example, a charge roller is shown in the drawing as the charging device, but a charging device which does not contact the image carrying member 1 may also be used. Also the cleaning blade does not have to be used.

The developing device 2 comprises: a developer container 16 which stores the developer 24; a developer carrying member 11 which carries on its surface the developer supplied from the developer container and conveys it; and a toner carrying member 25 which separates the toner from the developer on the developer carrying member.

The developer 24 includes the toner, a carrier for charging the toner and opposite polarity particles.

The toner carrying member 25 is provided between the developer carrying member 11 and the image carrying member 1. Between the toner carrying member 25 and the developer carrying member 11, an electric field is formed so that the toner is separated from the developer of the developer carrying member and moved to the toner carrying member side. The opposite polarity particles in the developer is held in the developer carrying member 11 side by the force of the electric field, and it is returned to the developer container 16, but the portion of the opposite polarity particles that is firmly attached to the toner moves to the toner carrying member 25 together with the toner.

In addition, an electric field is formed by the power supply 52 which is the voltage applying section so that the toner on the toner carrying member 25 develops the electrostatic latent image portion on the image carrying member 1 between the toner carrying member 25 and the image carrying member 1. It is to be noted that the image carrying member is grounded. The power supply 52 applies an bias voltage overlapped with alternating current in which direct current is overlapped with alternating current to the toner carrying member 25, and an alternating current bias electric field is formed in accordance with this voltage. The vibration waveform of this bias voltage overlapped with alternating current includes a trapezoidal waveform such as that shown in FIG. 2. By applying the bias voltage overlapped with alternating current including this type of trapezoidal waveform, toner which can be moved even by a weak electric field moves in the step where the strength of the electric field is gradually increased.

Figure 3:
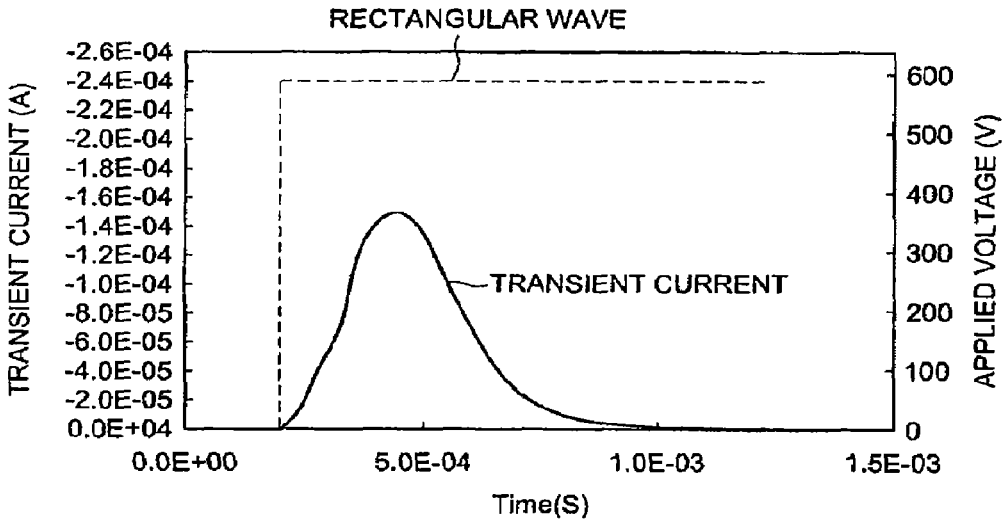
FIG. 3 shows the transient current that flows to the image carrying member when the bias voltage overlapped with alternating current which includes the rectangular is applied to the toner carrying member.
Figure 4:
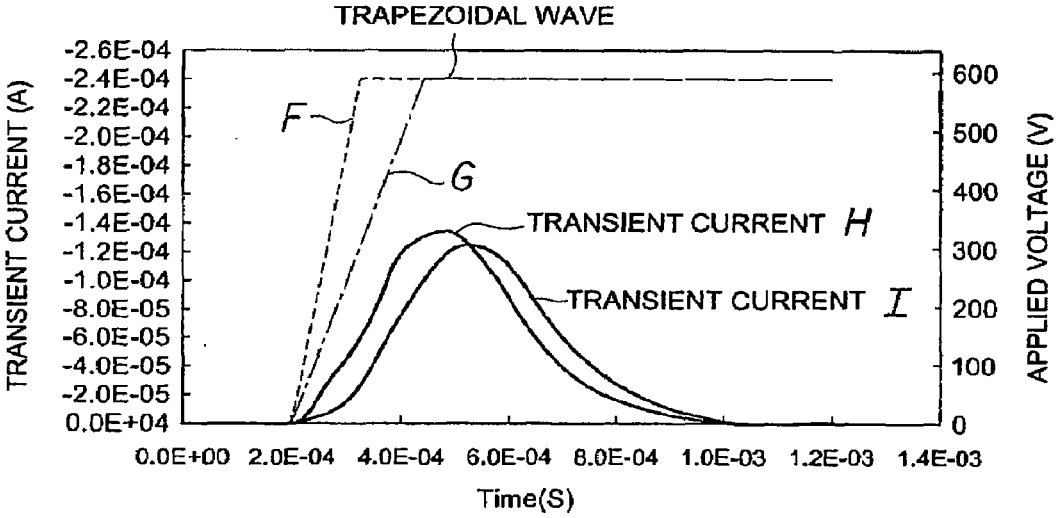
FIG. 4 shows the transient current that flows to the image carrying member when the bias voltage overlapped with alternating current which includes the trapezoidal wave is applied to the toner carrying member.

FIG. 3 shows the results of measuring the transient current (indicating the amount of the transferred toner) that flows to the image carrying member 1 when the toner moves from the toner carrying member 25 surface to the image carrying member 1 surface in the case where voltage with a rectangular waveform is applied as the vibration waveform. In addition, FIG. 4 shows the results of measuring the transient currents H and I which flow into the image carrying member, when the trapezoidal waves F and G are applied as the vibration waveforms. The distance between the toner carrying member 25 and the image carrying member 1 at this time is set at 0.2 mm. In addition, in order to measure the current occurred when the toner moves, component parts other than the image carrying member 1 and the toner carrying member 25 covered with the toner layer are removed, and voltage is applied in a stationary state. In addition, the amount of toner attached to the image carrying member 1 after voltage was applied, is substantially the same for each wave form. As a result, it was found that by using the trapezoidal wave, much of the toner to be moved is moved at the incline portion at initial start up. That is to say, because a large amount of toner moves before the electric field intensity between the toner carrying member 25 and the image carrying member 1 reaches a peak, the force of impact when the toner reaches the surface of the image carrying member 1 is weaker for the trapezoidal wave than for the rectangular wave.

By weakening the force of impact of the toner on the image carrying member, the separation of the opposite polarity particles from the toner can be prevented. The opposite polarity particles are apt to attach to the non-image regions on the image carrying member 1, but if a force which exceeds the force for attaching to the toner (van der Waals force and Coulomb force) is not applied, attachment of the opposite polarity particles to the non-image region can be prevented. As a result, the opposite polarity particles to be collected together with the toner can be increased and consumption of the opposite polarity particles from the developing apparatus 2 can be prevented. Even in the case where the large amounts of images with a small image area ratio are printed, excessive consumption of the opposite polarity particles from the developing device 2 does not occur. In addition, the consumed portion of the opposite polarity particles attached to the toner consumed at the image region, can be replenished by supplying a replenishing toner in which opposite polarity particles have been added in advance. In this manner, opposite polarity particles can be suitably supplied in accordance with consumption of the toner depending on the surface area ratio of the image to be printed, and even in the case where the image area ratio is extremely low, the amount of opposite polarity particles in the developing device is not reduced. Thus, by maintaining the amount of opposite polarity particles in the developing device, the toner charging ability of the carrier which gradually deteriorates can be compensated by the opposite polarity particles, and the toner charge amount is stable over a long period of time, and high quality image formation becomes possible.

Figure 2:
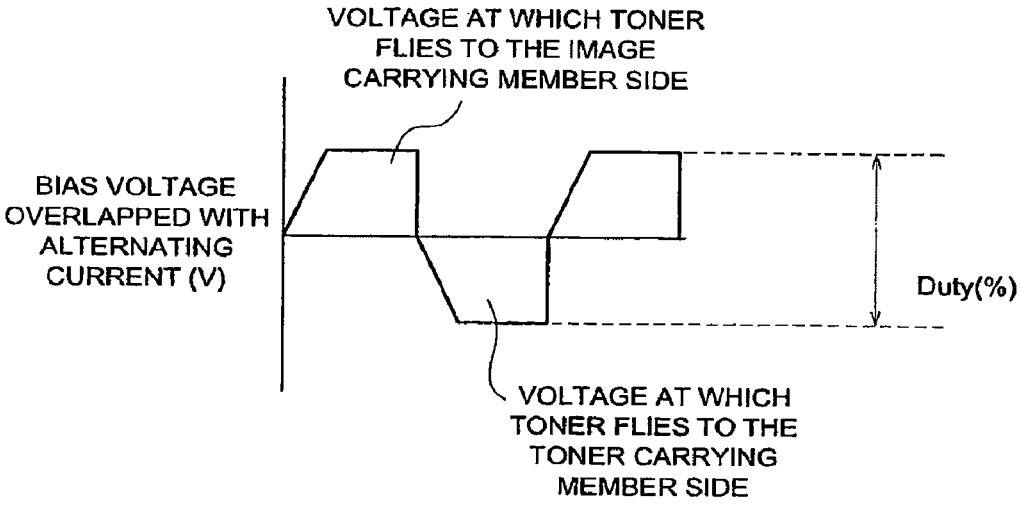
FIG. 2 shows a vibration waveform of a bias voltage overlapped with alternating current which includes the trapezoidal wave, the bias voltage that is applied to the toner carrying member in the first embodiment.

In addition, in the trapezoidal wave of the bias voltage overlapped with alternating current from the power supply 52, the configuration having a slope at the start portion as shown in FIG. 2 is more effective. By making the configuration such that the voltage gradually increases at start time, the impact force on the image carrying member 1 and the toner carrying member 25 of a greater amount of toner can be weakened.

Next, the second embodiment of the present invention will be described with reference to the drawings.

In the image forming apparatus of this embodiment, the voltage applied to the toner carrying member 25 is different from that of the first embodiment, but otherwise the structure is the same as shown in the first embodiment in FIG. 1 and descriptions thereof have been omitted.

It is to be noted that an electric field is formed in the space between the toner carrying member 25 and the image carrying member 1 by the power supply 52 which is the voltage applying section so that the image portion of the electrostatic latent image on the image carrying member 1 is developed. The power supply 52 forms an electric field between the toner carrying member 25 and the image carrying member 1, the electric field in which a cyclic vibration bias is overlapped on a direct current bias.

The vibration waveform of this cyclic vibration bias has a development side voltage component and a reverse development side voltage component, and a blank is inserted during the application of the reverse development side voltage component.

In this embodiment, the development side voltage component is a component having the same polar composition as charge polarity of the toner with reference to the electric potential of the toner carrying member 25. That is to say, it is a component which forms an electric field which moves the toner in the direction to the image carrying member 1. On the other hand, the reverse development side voltage component is a component which has the opposite polarity to the charge polarity of the toner with reference to the electric potential of the direct current bias of the toner carrying member 25. That is to say, it is a component which forms an electric field which holds the toner on the toner carrying member 25. In addition, inserting a blank during application of the reverse development side voltage component means that a region in which the vibration bias voltage is set to 0 V is provided during application of the reverse development side voltage.

Figure 11:
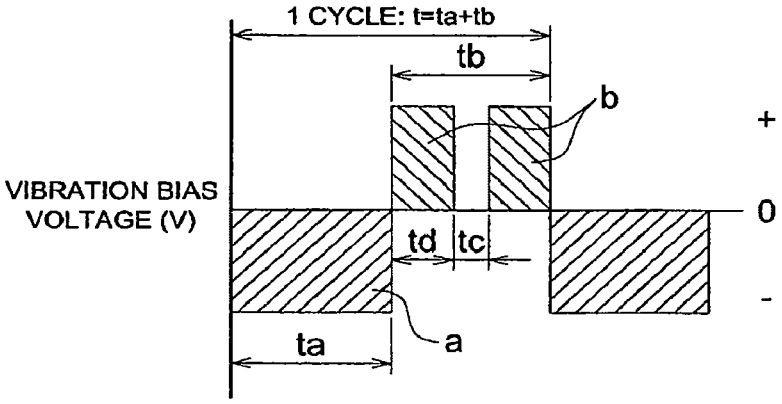
FIG. 11 shows the waveform of the vibration bias applied to the toner carrying member in this embodiment.

For example, in the case where the toner on the toner carrying member 25 is charged negative, and the waveform of the cyclic vibration bias shown in FIG. 11 is overlapped on the direct current component of the toner carrying member 25, with reference to the electric potential of the direct current component of the toner carrying member 25, the portion a is the developing side voltage component, and the portion b is the reverse development side voltage component. During application of the reverse development side voltage component, a blank is inserted such that the voltage is set to 0 V as shown by the region tc in the drawing. That is to say, in the period t of the vibration bias voltage, the development side voltage component is applied for a period ta and following this, the reverse development side voltage component is applied for a period tb. However, during the period tb, the blank is inserted for the period tc after the elapse of the period td from start of the reverse development side voltage component.

By inserting the blank during application of the reverse development side voltage component in this manner, the amount of the opposite polarity particles attached to the background portion (non-image portion) on the image carrying member 1 can be reduced. As a result, even if a large quantity of an image with extremely small image area is printed, consumption of the opposite polarity particles can be suppressed, and the amount of the opposite polarity particles inside the developer container 16 can be maintained. By maintaining the amount of the opposite polarity particles in the developer container 16, when the number of prints is increased, even if staining due to toner and external additive agents on the carrier surface progresses, and the charging performance of the toner due to the carrier decreases, the opposite polarity particles can charge the toner. As a result, toner charge amount reduction due to deterioration of the carrier that was a problem in the two-component development system and the resulting fogging of the image and toner splashing and the like can be controlled, and thus high quality images can be supplied over a long period of time.

The mechanism for reducing the composition of the opposite polarity particles into the background portion by inserting the blank within the reverse development side voltage component can be estimated as described below.

The opposite polarity particles that move from the developer carrying member 11 to the toner carrying member attach mainly to the toner due to the electrostatic force and the van der Waal force. These types of opposite polarity particles move together with the toner in the developing section as well. In the image portion that is on the image carrying member 1, the opposite polarity particles move to the image carrying member 1 together with the toner and are consumed. A reduction in the amount of opposite polarity particles that are consumed together with the toner is detected by the toner concentration detection section in the developer container 16 and is replenished as replenishing toner. By adding the opposite polarity particles to the toner in advance, the opposite polarity particles that were consumed can be replenished. However, the toner does not attach in the background section which is the non-image portion on the image carrying member 1 due to the polarity. In the case where the opposite polarity particles are firmly attached to the toner, the opposite polarity particles will not attach to the background portion, but in the case where blank is not inserted during application of the reverse development side voltage component of the vibration bias, it is observed that many opposite polarity particles attach to the background. For this reason, when a large quantity of images with a small image area ratio is to be printed, there can be seen a reduction in toner charge amount as the print volume increases. This is because the toner in the developing section moves back and forth between the image carrying member 1 and the toner carrying member 25 due to the vibration bias, and it is believed that this is caused by the opposite polarity particles separating from the toner due to the impact when the toner flies onto and collides with the toner carrying member 25. In particular, the opposite polarity particles that have been separated in the non-image portion attach to the background portion due to the polarity. When the opposite polarity particles are attached to the background portion in this manner, consumption of only the opposite polarity particles occurs, and the amount of the opposite polarity particles in the developer container 16 reduces. Thus, by inserting a blank whose voltage 0 V during applying the reverse development side component of the vibration bias, on order not to transfer the opposite polarity particles separated by the collision of the toner with the toner carrying member 25 onto the background portion, the strength of the electric field in the direction of movement of the opposite polarity particles onto the background portion is reduced, and attachment to the background portion of the opposite polarity particles is suppressed.

In addition, timing (td) for inserting the blank during the application of the reverse development side voltage component of the vibration bias is preferably between 0.1-0.2 ms from startup of the reverse development side voltage component of the vibration bias. If it is less than 0.1 ms, a large amount of the toner once transferred to the image carrying member 1 side has not yet reached the surface of the toner carrying member 25, and image fogging tends to occur. Also, if the timing exceeds 0.2 ms, a large amount of the opposite polarity particles that separated from the toner attaches to the background portion, and the effect of preventing attachment to the background portion is reduced, and in the case where large amounts of images with a small image area ratio is printed, reduction in the toner charge amount tends to occur, and image fogging and toner splashing tends to occur.

By inserting a blank during the application of the reverse development side component of the cyclic vibration bias in this manner, movement of the opposite polarity particles that have been separated from the toner to the background portion can be reduced. As a result, consumption of the opposite polarity particles from the developing device 2 can be prevented, and even in the case where images which have a small image area ratio are printed in large volumes, there is no excessive consumption of the opposite polarity particles from the developing device 2.

As a result, and even in the case where the image area ratio is extremely low at, the amount of opposite polarity particles in the developing device is not reduced, and the toner charging property of the carrier which gradually deteriorates with increase of print volume can be compensated by the opposite polarity particles, and the toner charge amount is stable over a long period of time, and high quality image formation is possible.

The opposite polarity particles used in the embodiments of the present invention are to be charged opposite to the charge polarity of the toner by triboelectric charging with the toner used. In the case where a toner that is negatively charged by the carrier is used, the opposite polarity particles are positively charged particles that are positively charged in the developer. On the other hand, in the case where a toner that is positively charged by the carrier is used, the opposite polarity particles are negatively charged particles that are negatively charged in the developer. The opposite polarity particles are included in the two-component system developer, and by causing accumulation of the opposite polarity particles in the developer, even if the carrier charging properties is deteriorated due to the spent of toner and the post processing agent to the carrier and the like, the deterioration can be compensated, because the opposite polarity particles can also charge the toner to the normal polarity, charging of the carrier can be effectively compensated, and as a result, carrier deterioration is suppressed. The number average particle diameter of the opposite polarity particles is preferably 100-1000 nm.

The opposite polarity particles are suitably selected depending on the charge polarity of the toner. In the case where a negative charge toner is used as the toner, particles having positive charging property are used as the opposite polarity particles. Examples of particles that may be used include inorganic particles such as strontium titanate, barium titanate, alumina and the like; thermoplastic resins or resins comprising thermoplastic resins such as acryl resins, benzoguanamine resins, nylon resins, polyimide resins, polyamide resins and the like. Also a positive charge control agent that imparts a positive charge may be included in the resin or the resin may comprise a copolymer of a nitrogen containing monomer. Nigrosine dyes, quaternary ammonium salts and the like may be used as the positive charge control agent herein, and 2-dimethyl amino ethyl acrylate, 2-diethyl amino ethyl acrylate, 2-dimethyl amino ethyl metacrylate, 2-diethyl amino ethyl metacrylate, vinyl pyridine, N-vinyl carbazole, vinyl imidazole and the like can be used as the foregoing nitrogen containing monomer.

Meanwhile, in the case where the positive charge toner is used particles having positive charging property are used as the opposite polarity particles. Examples of particles that may be used include inorganic particles such as silica and titanate as well as thermoplastic resins or resins comprising thermoplastic resins such as fluorine resins, polyolefin resins, silicone resins, polyester resins and the like. Also a negative charge control agent that imparts a negative charge may be included in the resin or the resin may comprise a copolymer of a fluorine containing acrylic monomer or a fluorine containing acrylic monomer. Salicyclates and naphtolates of chromium complexes, iron complexes, zinc complexes and the like may be used as the negative charge control agent.

In addition, in order to control the charging property and the hydrophobic property of the opposite polarity particles, the surface of the inorganic particles may be subjected to surface treatment using a silane coupling agent, a titan coupling agent, silicone oil and the like. In particular, in the case where positive charging properties are to be imparted to the inorganic particles, it is preferable that surface processing is performed with an amino containing coupling agent, and in addition, in the case where negative charging properties are to be imparted, it is preferable that surface processing is performed with a fluorine containing coupling agent.

No particular limit is imposed on the toner, and a generally used known toner can be used. Also colorant may be included in the binder resin, or as necessary charge control agent or separating agent may be included or it may be processed by an external additive agent. No particular limit is imposed on the toner diameter, but it is preferably between 3 and 15 μm.

The method for manufacturing this type of toner can be a generally used known method, and examples of the methods that can be used include the grinding method, the emulsification polymerization method and suspension polymerization method.

In addition, generally used known additives may be used as the foregoing external additive agent, and for liquid property improvement, for example, inorganic particles such as silica, titan oxide, aluminum oxide and the like may be used; resin particles such as acrylic resin, styrene resin, silicone resin, fluorine resins and the like may be used. In particular, those that have been made hydrophobic using silane coupling agents, titan coupling agents, and silicone oils are preferable. In addition, a plasticizer should be added in a proportion of 0.1-5 parts by mass for to 100 parts by mass of the toner.

No particular limitation is imposed on the carrier, and a generally known used carrier such as a binder type carrier, a coat type carrier or the like may be used. No particular limit is imposed on the carrier particle diameter, but it is preferably between 15 and 100 μm.

Meanwhile, the coat type carrier is a carrier in which carrier core particles formed of magnetic bodies are resin-coated. As is the case with the binder type carrier, in the coat type carrier also, positively or negatively charged particles can be adhered to the carrier surface. The charging properties of the coat type carrier such as polarity can be controlled by the type of surface coating layer and the charging particles.

Figure 5:
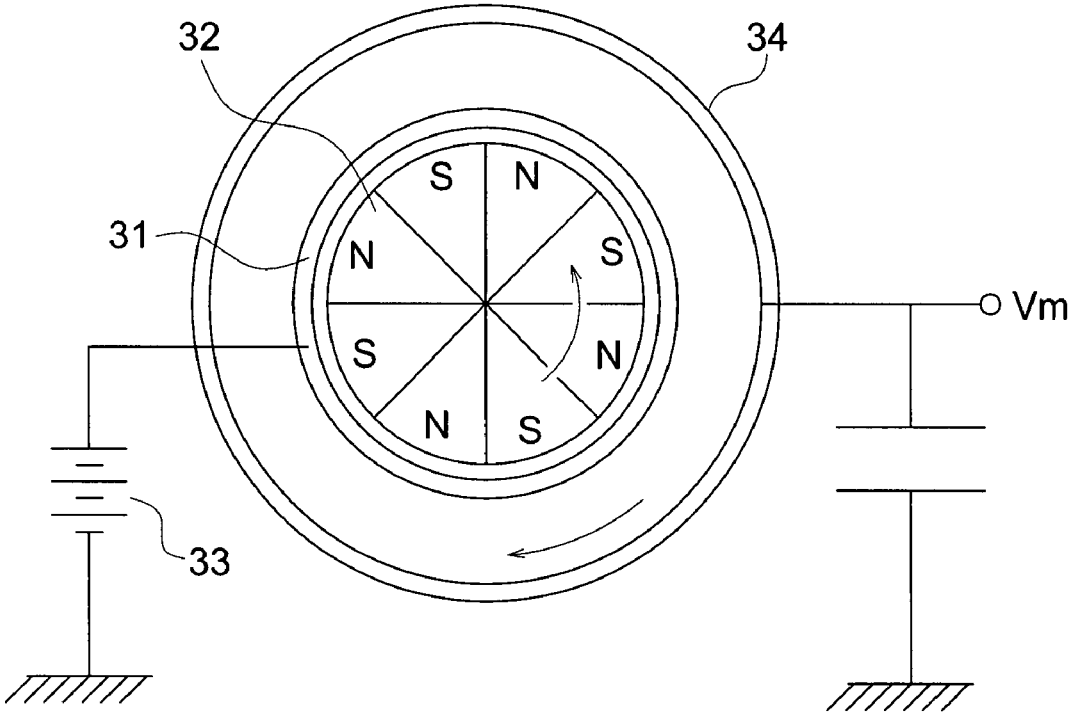
FIG. 5 is a schematic view of the device that measures the charge amount of the charged particles.

The charge polarity of the toner or the opposite polarity particles of the developer formed of the combination of the opposite polarity particles, the toner and the carrier can be easily determined from the direction of the electric field when the toner or the opposite polarity particles are separated, after the components have been mixed and agitated, from the developer using a device such as that shown in FIG. 5. FIG. 5 is a schematic view of the device that measures the charge amount of the charged particles of the toner and the like.

That is to say, in the device shown in FIG. 5, the developer formed of the toner, the carrier, and the opposite polarity particles is evenly coated over the entire surface of the conducting sleeve 31, and the rotation frequency of the magnetic roller 32 provided inside the conductive sleeve 31 is set to 1000 rpm, and a bias voltage of 2 kV with the same polarity as the charge potential of the toner is applied by the bias power supply 33, and the conductive sleeve 31 is rotated for a period of 15 seconds, and the electric potential Vm in the cylindrical electrode 34 at the point when the conducting sleeve is stopped is read, and the weight of the toner that attached to the cylindrical electrode 34 is measured using an accurate balance, and thus the charge amount of the toner can be obtained.

In addition, when the bias voltage that is applied by the bias power supply 33 is applied with the opposite polarity of the charge potential of the toner, the particles which attach to the cylindrical electrode 34 have the opposite polarity to the charge polarity of the toner, or in other words, are the opposite polarity particles.

The mixing ratio of the toner and the carrier should be adjusted in order to obtain the desired toner charge amount, and the toner proportion should be 3-50% by mass, and more preferably 6-30% by mass of the total amount of the toner and the carrier.

No particular limitation is imposed on the amount of opposite polarity particles included in the initial developer as long as the object of the present invention is achieved, and the amount may be for example 0.01-5.00% by mass of the carrier, and 0.01-2.00% by mass of the carrier is particularly preferable.

The developer is preferably prepared by mixing the toner with the carrier after the opposite polarity particles are externally added to the toner.

The developer carrying member 11 is formed of a magnetic roller 13 that is fixedly arranged and a rotatable sleeve roller 12 containing the magnetic roller 13 therein. The magnetic roller 13 has 5 poles N1, S1, N3, N2 and S2 which are along the rotational direction B of the sleeve roller 12. Of these poles, the main pole N1 is arranged at a position of the developing region 6 facing the image carrying member 1, and the homopolar portions N3 and N2 which generate a repelling magnetic field for stripping the developer 24 on the sleeve roller 12 are arranged at positions facing the inside of the developer container 16.

The developer container 16 is formed of a casing 18, and normally, contains inside thereof the developer supply bucket roller for supplying the developer to the developer carrying member 11. An ATDC (automatic toner density control) sensor 20 for toner density detection is preferably provided at a position opposing the bucket roller of the caging 18.

The developing device 2 usually comprises a supply section 7 for supplying the amount of toner that is to be consumed at the developing region 6 to the developer container 16, and a regulating member (regulating blade) 15 for forming a thin developer layer for regulating the amount of developer on the developer carrying member 11. The supply section comprises a hopper 21 which stores the replenishing toner 23 and a supply roller 19 for supplying the toner to the developer container 16.

A toner to which the opposite polarity particles have been externally added is used as the replenishing toner 23. By using the toner to which opposite polarity particles have been externally added, it became possible to effectively assist charge reduction of the carrier which gradually deteriorates. The amount of the opposite polarity particles added to the replenishing toner 23 is preferably 0.1-10.0% by mass of the toner and particularly preferable is 0.5-5.0% by mass.

The toner separating bias voltages should be varied depending on the charge polarity of the toner, the toner separating bias voltages which are applied to the toner carrying member 25 and the developer carrying member 11 by the power supplies 51 and 52 for separating the toner from the developer on the developer carrying member 11. That is to say, in the case where negative charge toner is used, the average value of the electric potential of the toner carrying member 25 is higher than the average value of the electric potential of the developer carrying member 11. On the other hand, in the case where positive charge toner is used, voltage is applied such that the average value of the electric potential of the toner carrying member 25 is lower than the average value of the electric potential of the developer carrying member 11. Whichever the positive charge toner or negative charge tone is used, the difference between the average electric potentials of the toner carrying member 25 and the developer carrying member 11 is preferably 20-500 V, and 50-300 V is particularly preferable. If the electric potential difference is too small, it will be difficult to sufficiently separate the toner. On the other hand, if the electric potential difference is too large, the carrier that is held by magnetic force on the developer carrying member is separated due to the electric field, and there is a concern that original developing function in the developing region may be deteriorated.

In the developing device 2, it is also preferable that an alternating current electric field is formed between the toner carrying member 25 and the developer carrying member 11. By forming the alternating current electric field, the toner can be effectively separated because the toner vibrates back and forth. At this time, it is preferable that an electric field of $2.5\times10^6$ V/m or higher is formed. By forming an electric field of $2.5\times10^6$ V/m or higher, it becomes possible for the toner to be separated from the developer carrying member by the electric field, and thus it becomes possible for the separation of the toner to be improved even more.

In this specification, the electric field between the toner carrying member 25 and the developer carrying member 11 is called the toner separation field. It is preferable that the alternating current voltage applied to the toner carrying member 25 is used to form the toner separation field. At this time, the maximum value for the absolute value of the toner separation field should be $2.5\times10^6$ V/m or higher.

The toner carrying member 25 can be formed of any material provided that voltage can be applied, and an example is aluminum rollers that have been subjected to surface processing. In addition, a conductive substrate such as aluminum and the like may be coated with a resin coating such as a polyester resin, polycarbonate resin, acrylic resin, polyethylene resin, polypropylene resin, urethane resin, polyamide resin, polyimide resin, polysulfon resin, polyether ketone resin, vinyl chloride resin, vinyl acetate resin, silicone resin, fluorine resin and the like as well as rubber coating such as silicone rubber, urethane rubber, nitryl rubber, natural rubber, isoprene rubber and the like. The coating material however, is not to be limited to these materials. A conducting agent may be further added to the foregoing coating bulk or to the surface. Examples of the conducting agent include electron conducting agents or ion conducting agents. Examples of the electron conducting agents include, without being limited to, carbon black such as ketchen black, acetylene black, furnace black and the like and fine particles such as metal powder, metal oxides and the like. Examples of the ion conducting agent include, without being limited to, cationic compounds such a quaternary ammonium salts, amphoteric compounds, as well as ionic polymer materials. In addition, conduction rollers formed from metal materials such as aluminum and the like may be used.

Figure 6:
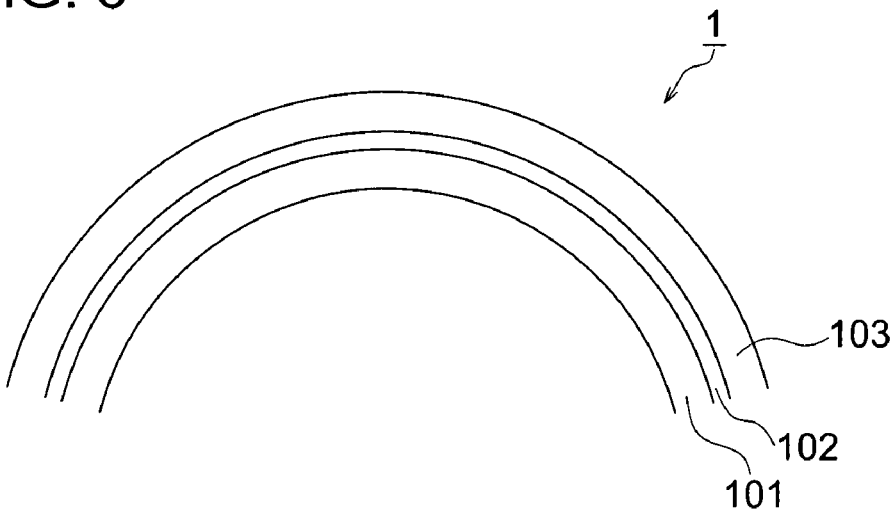
FIG. 6 is a pattern diagram showing the structure of the image carrying member of an embodiment.

FIG. 6 is a pattern diagram showing the structure of the image carrying member 1.

The image carrying member (photoconductor) 1 is formed of an aluminum cylindrical substrate (conductive supporting member) 101 on which an underlying layer 102, photosensitive layer 103 are formed sequentially in that order. The photosensitive layer 103 can be a function-separated type layer made up of a charge generation layer followed by a charge transport layer. It can be either a function-separated type layer or a single layer type layer wherein a charge generation material and charge transport layer are dispersed in resins. The following describes the function-separated type image carrying member 1.

In the first place, a charge generation layer is formed on a conductive supporting member. The charge generation layer is formed by vacuum deposition of a charge generation material, by coating and drying the charge generation material dissolved in amine based solvent, or by coating and drying the coating solution prepared by dispersing the charge generation material in a solution in which appropriate solvent or, if required, binder resin is dissolved. The thickness of the charge generation layer is preferably in the range of 0.01 through 5 μm, more preferably in the range of 0.1 through 2 μm.

The examples of the conductive supporting member 101 include an ED tube produced by extrusion followed by cold drawing; a cut tube produced by cutting an aluminum pipe produced by extrusion followed by cold drawing, wherein the outer surface is cut by about 0.2 through 0.3 mm using a cutting tool such as a diamond tool; an EI tube produced by forming an aluminum disk into a cup by impact processing wherein the outer surface is finished by ironing thereafter; and a DI tube produced by deep drawing of an aluminum disk wherein the outer surface is finished by ironing thereafter. These examples also include the products wherein these surfaces are further machined, are subjected to anode oxidation, or pore-sealing after anode oxidation.

Prior to formation of a charge generation layer, an underlying layer 102 can be formed on the conductive supporting member 101 to prevent electric charge from being injected from the conductive supporting member. When the underlying layer is provided, the appropriate materials include the resin that can be dissolved in water or alcohol as exemplified by polyamide, polyvinyl alcohol, copolymerized nylon; the curable resin such as polyurethane and epoxy resin; or the material dispersed with low-resistance compounds such as tin oxide and indium oxide. In this case, the preferred film thickness of the underlying layer is 1 μm or less.

Examples of the charge generating material include bis azo pigments, pyrylium dyes, azo dyes, perylene pigments, squalium pigments, phthalocyanine pigments and the like. In the case where the charge generating layer is formed by dispersing the charge generating material in a binding resin, the amount of the charge generating material to be included in the layer is preferably 10-400 parts by mass for 100 parts by mass of the binding resin or more preferably 50-250 parts by mass. In this case, examples of the binding resin include thermoplastic resins such as butyral resin (polyvinyl butyral), polyether resin and the like and photocure resins such as epoxy resins, alkyd resins, urethane resins, silicone resins, phenol resins and the like.

This is followed by the step of forming a charge transport layer. The charge transport layer is formed by coating the aforementioned charge generation layer with a coating solution containing at least a charge transport generation material, binder resin and organic solvent, and by drying the layer. The thickness of the charge transport layer is preferably in the range of 4 through 50 μm, more preferably in the range of 10 through 30 μm.

The charge transport material that can be used to form a charge transport layer is exemplified by hydrazone compound, styryl compound, stilbene compound, triphenylamine compound, and tetraphenyl benzidine compound. They can be used independently, or two or more of them can be used in combination. The amount of the charge transport material contained is preferably in the range of 2 through 200 parts by mass, more preferably in the range of 50 through 120 parts by mass, with respect to 100 parts by mass of binder resin. The binder resin used to form a charge transport layer is exemplified by polycarbonate resin, polyester resin and polyarylate resin. A phenol or amine based antioxidant is preferably added in order to minimize deterioration in durability.

According to an embodiment of the present invention, even in the case where large quantities of images with small image area ratio are printed, consumption of the opposite polarity particles by the image carrying member is controlled, and toner charge reduction due to the carrier deterioration is suppressed, and high quality images can be formed over a long period of time.

EXAMPLES

The toner and photoconductor used in the examples will be described in the following.

As for the toner, 0.2 parts by mass of the first hydrophobic silica, 0.5 parts by mass of the second hydrophobic silica and 0.5 parts by mass of hydrophobic titanium oxide were externally added to 100 parts by mass of toner base material having a particle size of 6.5 μm prepared by the wet palletizing method by surface treatment at a speed of 40 m/s for three minutes using the Henschel mixer (by Mitsui Mining and Smelting Co., Ltd.).

The first hydrophobic silica used here was prepared by surface treatment of silica (#130 by Nippon Aerosil Co., Ltd.) having an average primary particle size of 16 nm, using the hexamethyldisilane (HMDS) as a hydrophobing agent. Further, the second hydrophobic silica was obtained by surface treatment of silica (#90G by Nippon Aerosil Co., Ltd.) having an average primary particle size of 20 nm, using hexamethyldisilazane (HMDS). The hydrophobic titanium oxide was obtained by surface treatment of the anatase type titanium oxide having an average primary particle size of 30 nm in an aqueous wet environment, using the isobutyltrimethoxy silane as a hydrophobing agent.

Toner was prepared by external addition of 2 parts by mass of the strontium titanate as opposite polarity particles having an average primary particle size of 350 nm with respect to 100 parts by mass of toner base material particles at a speed of 40 m/s for three minutes, similarly using the Henschel mixer.

Example 1

As for the photoconductor, the surface of the JIS 5657 cylindrical aluminum alloy (having an outer diameter 30 mm with a thickness of 1 mm) was machined using a cutting tool with a natural diamond employed as a cutting blade. After that, this alloy was degreased and was rinsed in running water. It was then anode-oxidized to form an anodized layer having a thickness of 8 μm. This was rinsed by running pure water and was then subjected to pore sealing using a pore sealing agent containing nickel acetate, thereby obtaining a photoconductor substrate wherein the anodized layer was pore-sealed in this manner. The following describes the procedure of forming the photosensitive layer:

One part of butylal resin (ESREC BX-1 by Sekisui Chemical Co., Ltd.) and one part of titanyl phthalocyanine (am-TiOPc by Toyo Ink Mfg. Co., Ltd.) were added to 100 parts of tetrahydrofuran. The mixture was dispersed by a sand mill for five hours to prepare a coating solution for the charge generation layer. The aforementioned supporting member was immersed in this coating solution for charge generation layer and was coated, thereby preparing a charge generation layer having a film thickness of 0.2 μm. 100 parts of polycarbonate resin (Panlite TS-2020 by Teijin Chemical Industries Co., Ltd.), 70 parts of styryl compound as a charge transport agent, and 8 parts of phenol compound butylhydroxy toluene were dissolved in 1000 parts of tetrahydrofuran, whereby the coating solution for charge transport layer was prepared. The aforementioned charge generation layer was immersed in the coating solution for charge transport layer and is coated. This was dried by air blast, whereby a charge transport layer having a film thickness of 20 μm was prepared.

Figure 7:
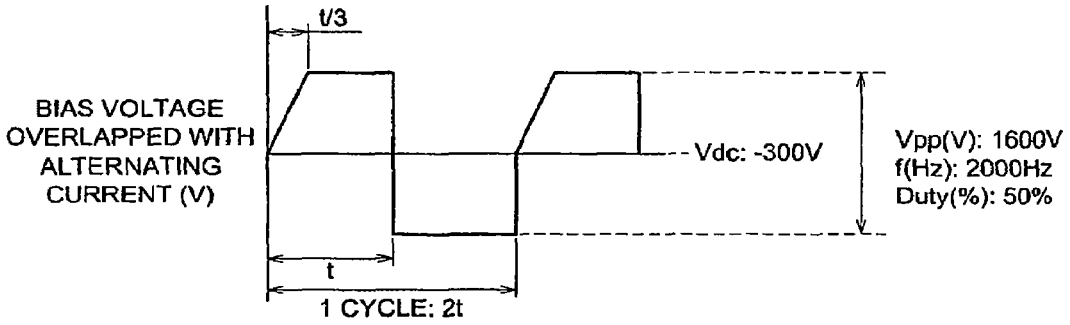
FIG. 7 shows the vibration waveform of the bias voltage overlapped with alternating current which includes the trapezoidal wave, the bias voltage that is applied to the toner carrying member in Example 1.

The developing device shown in FIG. 1 was used and a carrier (particle diameter approximately 33 μm) for bizhub C350 manufactured by Konica Minolta was used as the developer. The toner proportion in the developer was set to 8% by mass. A direct current voltage of −400 V was applied to the developer carrying member. A trapezoidal wave developing bias having a peak to peak voltage (Vpp) of 1.6 kV, DC component ($V_{dc}$) of −300 V, duty ratio of 50% and a frequency (f) of 2 kHz was applied to the toner carrying member. FIG. 7 shows the configuration of the trapezoidal wave. The average electric potential of the toner carrying member with respect to the electric potential of the developer carrying member has an electric potential difference of 100 V, the maximum electric potential difference is an electric potential difference of 900 V. An aluminum roller whose surface has been subjected to alumite processing is used for the toner carrying member, and the gap of the closest portion between the developer carrying member and the toner carrying member was set to 0.3 mm. The electric potential of the background portion is −550 V and the electric potential of the image portion is −60 V for the electrostatic latent image formed on the image carrying member 1, and the gap of the closest portion between the image carrying member 1 and the toner carrying member 25 was set to 0.15 mm. The maximum value for the absolute value of the toner separating electric field formed between the toner carrying member 25 and the developer carrying member 11 is 900 V/0.3 mm, which is $3.0\times10^6$ V/m.

Example 2

Figure 8:
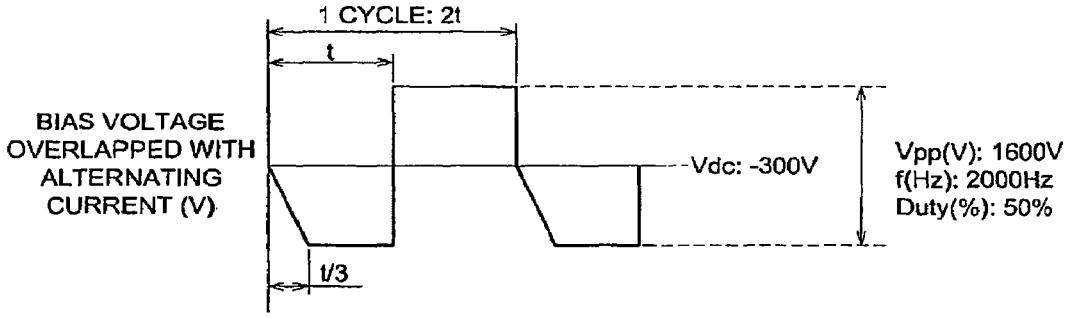
FIG. 8 shows the vibration waveform of the bias voltage overlapped with alternating current which includes the trapezoidal wave, the bias voltage that is applied to the toner carrying member in Example 2.

Example 2 was performed in the same manner as Example 1 except that the trapezoidal wave vibrating bias shown in FIG. 8, which has a peak to peak voltage (Vpp) of 1600 V, duty ratio of 50% and a frequency (f) of 2000 Hz was applied to the toner carrying member.

Example 3

Figure 9:
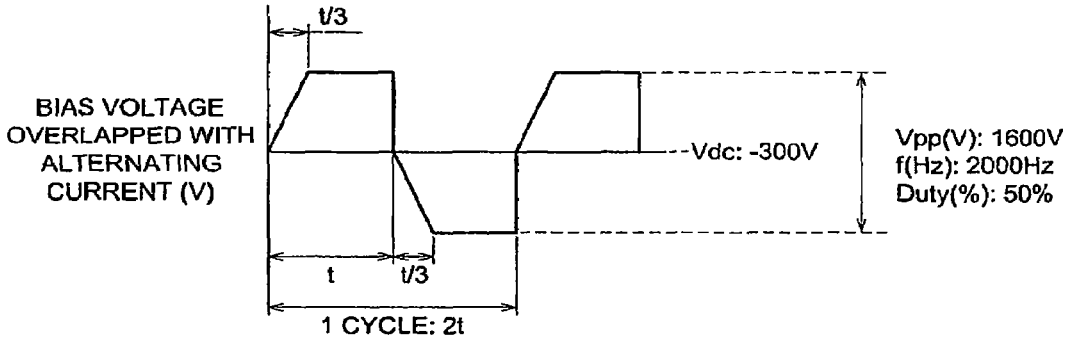
FIG. 9 shows the vibration waveform of the bias voltage overlapped with alternating current which includes the trapezoidal wave, the bias voltage that is applied to the toner carrying member in Example 3.

Example 3 was performed in the same manner as Example 1 except that the trapezoidal wave vibrating bias shown in FIG. 9, which has a peak to peak voltage (Vpp) of 1600 V, duty ratio of 50% and a frequency (f) of 2000 Hz was applied to the toner carrying member.

Comparative Example 1

Figure 10:
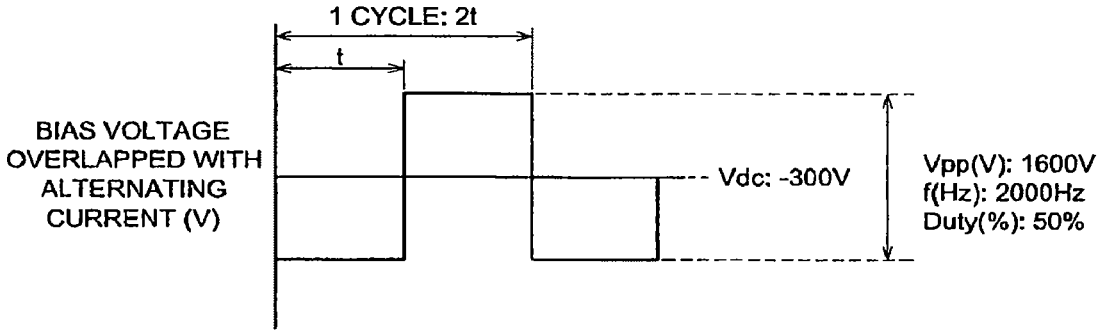
FIG. 10 shows the vibration waveform of the bias voltage overlapped with alternating current which includes the rectangular wave, the bias voltage that is applied to the toner carrying member in Comparative Example 1.

Comparative Example 1 was performed in the same manner as Example 1 except that the rectangular wave vibrating bias shown in FIG. 10, which has a peak to peak voltage (Vpp) of 1600 V, duty ratio of 50% and a frequency (f) of 2000 Hz was applied to the toner carrying member.

(Evaluation 1)

Ten A4-sized sheets in landscape orientation with an image area ratio of 0% (blanc sheets) were printed together with the aforementioned Examples 1-3 and Comparative example 1. The operation was forcibly suspended in the middle of formation of the image with an area ratio of 0% on the 11th sheet. The opposite polarity particles attached to the image carrying member 1 subsequent to development and prior to transfer were observed at four positions using a scanning electron microscope (SEM), and then comparison was made. The result of the observation is given in Table 1. In the observation, the surface of the image carrying member 1 was magnified by 20,000 times by the SEM, and the numbers of the opposite polarity particles per screen were compared.

TABLE 1

| No. | Example 1 | Example 2 | Example 3 | Comparative example 1 |
|---|---|---|---|---|
| 1 | 21 | 15 | 23 | 81 |
| 2 | 18 | 18 | 15 | 75 |
| 3 | 19 | 17 | 20 | 93 |
| 4 | 22 | 19 | 18 | 82 |

It was confirmed that the amount of opposite polarity particles attached to the image carrying member 1 in Examples 1-3 was less than in Comparative Example 1. This shows that by applying the bias voltage overlapped with alternating current including trapezoidal waves between the toner carrying member and the image carrying member, it becomes difficult for the opposite polarity particles to attach to the non-image portion of the image carrying member.

(Evaluation 2)

In Examples 1-3 and Comparative Example 1 above, durability tests were performed for 50,000 sheets with image area ratio of 3%. Table 2 shows the toner charge amount before and after the durability tests.

TABLE 2

| | Toner charge amount (−μC/g) | | |
|---|---|---|---|
| | Number of sheets printed Initial | Number of sheets printed 50,000 sheets | Change in toner charge amount (−μC/g) |
| Example 1 | 32.0 | 31.5 | −0.5 |
| Example 2 | 33.0 | 32.5 | −0.5 |
| Example 3 | 31.5 | 31.0 | −0.5 |

TABLE 2-continued

| | Toner charge amount (−μC/g) | | |
|---|---|---|---|
| | Number of sheets printed Initial | Number of sheets printed 50,000 sheets | Change in toner charge amount (−μC/g) |
| Comparative Example 1 | 32.5 | 27.6 | −4.9 |

Comparative Example 1 shows a slight reduction of the toner charge, while Examples 1-3 confirmed that charging properties were maintained. In addition, after 50,000 sheets, in Comparative Example 1, some fogging was observed on the image, while in Examples 1-3, there was no fogging observed at all.

As shown above, by applying a bias voltage overlapped with alternating current which includes the trapezoidal wave including a slope on the rising edge, between the toner carrying member and the image carrying member, even when large amounts of image having a low image area ratio are printed, consumption of the opposite polarity particles can be suppressed, and reduction in the toner charge amount due to deterioration of the carrier can be compensated by the opposite polarity particles. As a result, an image forming device can be provided in which high quality images can be formed over a long period of time.

Example 4

Figure 12:
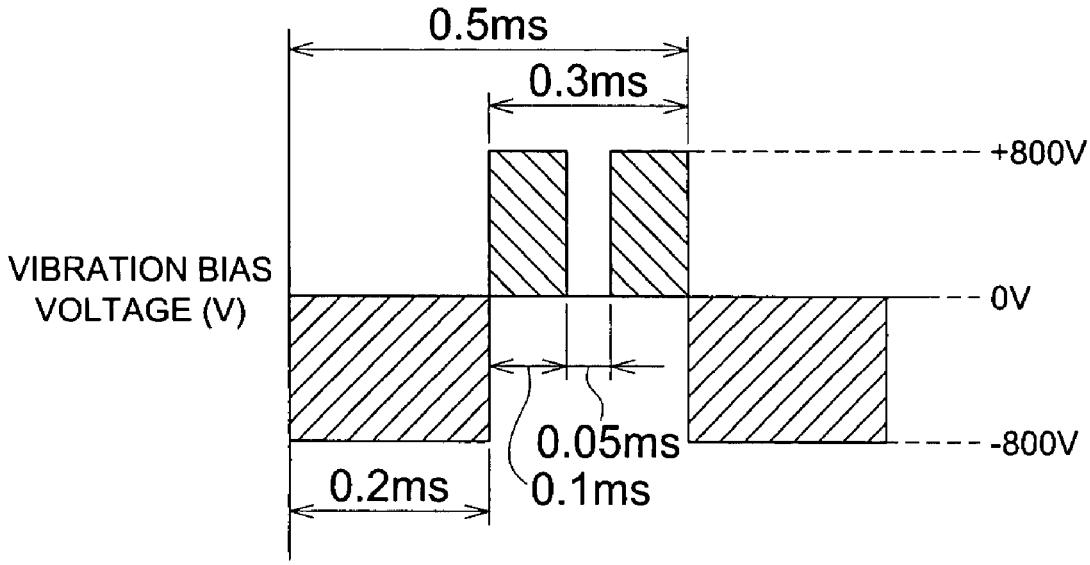
FIG. 12 shows the waveform of the vibration bias applied to the toner carrying member in Example 4.

The developing device shown in FIG. 1 was used and a carrier (particle diameter approximately 33 μm) for bizhub C35 manufactured by Konica Minolta was used as the developer. The toner proportion in the developer was set to 8% by mass. A direct current voltage of −400 V was applied to the developer carrying member. A bias was applied to the toner carrying member, the bias in which a DC component of −300 V was overlapped on a rectangular cyclic vibration bias, of 1.6 kV peak-to-peak voltage and a frequency of 2 kHz, having a blank (0 V) inserted for 0.05 ms at 0.1 ms after the rising edge of the waveform as shown in FIG. 12. The average electric potential of the toner carrying member with respect to the average electric potential of the developer carrying member has an electric potential difference of 100 V, and the maximum electric potential difference is 900 V. An aluminum roller whose surface has been subjected to alumite processing is used for the toner carrying member, and the gap of the closest portion between the developer carrying member and the toner carrying member was set to 0.3 mm. The electric potential of the background portion is −550 V and the electric potential of the image portion is −60 V for the electrostatic latent image formed on the image carrying member, and the gap of the closest portion between the image carrying member 1 and the toner carrying member 25 was set to 0.15 mm. The maximum value for the absolute value of the toner separating electric field formed between the toner carrying member 25 and the developer carrying member 11 is 900 V/0.3 mm, which is $3.0\times10^6$ V/m.

Comparative Example 2

Comparative Example 2 is the same as Example 4 except that a blank bias is not applied during application of the reverse development component of the vibration bias.

(Evaluation 3)

Ten A4-sized sheets in landscape orientation with an image area ratio of 0% (blanc sheets) were printed together with the aforementioned Examples 4 and Comparative example 2. The operation was forcibly suspended in the middle of formation of the image with an area ratio of 0% on the 11th sheet. The opposite polarity particles attached to the image carrying member 1 subsequent to development and prior to transfer were observed at four positions using a scanning electron microscope (SEM), and then comparison was made. The result of the observation is given in Table 3. In the observation, the surface of the image carrying member 1 was magnified by 20,000 times by the SEM, and the numbers of the opposite polarity particles per screen were compared.

TABLE 3

| No. | Example 4 | Comparative Example 2 |
|---|---|---|
| 1 | 42 | 78 |
| 2 | 34 | 95 |
| 3 | 44 | 81 |
| 4 | 47 | 79 |

The results in Table 3 shows that the amount of opposite polarity particles attached to the background portion of the image carrying member was little because the 0 V blank was inserted during application of the reverse development side voltage component of the vibration bias.

Examples 5-8

The conditions for Examples 5-8 are the same as those of Example 4 except that the timing of applying the blanks, in Example 4 which is 0.1 ms, is changed to the values shown in Table 4. Durability tests were performed for 50,000 sheets with image area ratio of 3%. Table 2 shows the toner charge amount on the toner carrying member before and after durability testing.

TABLE 4

| | Timing of applying blank (ms) | Toner charge amount (−μC/g) Initial | 50,000 sheets | Change in toner charge amount (−μC/g) |
|---|---|---|---|---|
| Example 4 | 0.1 | 32.1 | 31.2 | −0.9 |
| Example 5 | 0.05 | 31.9 | 30.2 | −1.7 |
| Example 6 | 0.15 | 32.3 | 31.8 | −0.7 |
| Example 7 | 0.2 | 32.1 | 31.6 | −0.5 |
| Example 8 | 0.22 | 32.5 | 30.1 | −2.4 |

From the results in Table 4, when the timing of applying the blank is 0.1-0.2 ms, there is little change in charge amount, and thus, more favorable results are shown.

What is claimed is:

1. An image forming apparatus, comprising:

an image carrying member which is adapted to carry an electrostatic latent image;

a developer container which is adapted to contain a developer including a toner, a carrier for charging the toner, and opposite polarity particles to be charged opposite to a charge polarity of the toner;

a developer carrying member which is adapted to convey the developer supplied from the developer container;

a toner carrying member which is adapted to receive the toner from the developer on the developer carrying member and to convey the toner to a development position facing the image carrying member to develop the electrostatic latent image on the image carrying member; and an electric field forming section which is adapted to form an electric field between the image carrying member and the toner carrying member, the electric field including a DC component overlapped with an AC component, wherein the AC component of the electric field formed by the electric field forming section includes a trapezoidal wave.

2. The image forming apparatus of claim 1, wherein the trapezoidal wave includes a slope on a leading edge thereof.

3. The image forming apparatus of claim 1, wherein a number average particle diameter of the opposite polarity particles is from 100 to 1000 nm.

4. The developing apparatus of claim 1, further comprising:

a supplying mechanism which is adapted to supply the developer container with a toner to which opposite polarity particles are externally added.

5. An image forming apparatus, comprising:

an image carrying member which is adapted to carry an electrostatic latent image;

a developer container which is adapted to contain a developer including a toner, a carrier for charging the toner, and opposite polarity particles to be charged opposite to a charge polarity of the toner;

a developer carrying member which is adapted to convey the developer supplied from the developer container;

a toner carrying member which is adapted to receive the toner from the developer on the developer carrying member and to convey the toner to a development position facing the image carrying member to develop the electrostatic latent image on the image carrying member; and an electric field forming section which is adapted to form an electric field between the image carrying member and the toner carrying member, the electric field including a DC component overlapped with an AC component, wherein the AC component of the electric field formed by the electric field forming section includes a developing component which moves the toner to the image carrying member and a reverse-developing component which moves the toner to the toner carrying member, and a blank is formed within the reverse-developing component.

6. The image forming apparatus of claim 5, wherein the AC component includes a rectangular wave.

7. The image forming apparatus of claim 5, wherein the blank is formed at a timing from 0.1 to 0.2 ms after a leading edge of the reverse-developing component.

8. The image forming apparatus of claim 5, wherein a number average particle diameter of the opposite polarity particles is from 100 to 1000 nm.

9. The image forming apparatus of claim 5, further comprising:

a supplying mechanism which is adapted to supply the developer container with a toner to which opposite polarity particles are externally added.

10. A method for forming an image, the method comprising the steps of:

forming an electrostatic latent image on an image carrying member;

supplying a developer carrying member with a developer including a toner, a carrier for charging the toner, and opposite polarity particles to be charged opposite to a charge polarity of the toner;

transferring the toner from the developer carrying member onto the toner carrying member;

conveying the toner to a position facing the image carrying member by a movement of a surface of the toner carrying member, the opposite polarity particles being attached to the toner; and forming an electric field including a DC component overlapped with an AC component between the image carrying member and the toner carrying member to develop the electrostatic latent image on the image carrying member with the toner on the toner carrying member, the AC component including a trapezoidal wave.

11. The method of claim 10, wherein the trapezoidal wave includes a slope on a leading edge thereof.

12. A method for forming an image, the method comprising the steps of:

forming an electrostatic latent image on an image carrying member;

supplying a developer carrying member with a developer including a toner, a carrier for charging the toner, and opposite polarity particles to be charged opposite to a charge polarity of the toner;

transferring the toner from the developer carrying member onto the toner carrying member;

conveying the toner to a position facing the image carrying member by a movement of a surface of the toner carrying member, the opposite polarity particles being attached to the toner; and forming an electric field including a DC component overlapped with an AC component between the image carrying member and the toner carrying member to develop the electrostatic latent image on the image carrying member with the toner on the toner carrying member, the AC component including a developing component which moves the toner to the image carrying member and a reverse-developing component which moves the toner to the toner carrying member, and a blank being formed within the reverse-developing component.

13. The method of claim 12, wherein the AC component includes a rectangular wave.

14. The method of claim 12, wherein the blank is formed at a timing from 0.1 to 0.2 ms after a leading edge of the reverse-developing component.

* * * * *